United States Patent [19]

Beisser

[11] Patent Number: 4,651,412

[45] Date of Patent: Mar. 24, 1987

[54] ELECTRIC TRANSFORMER AND METHOD FOR THE MANUFACTURE OF THE TRANSFORMER

[75] Inventor: Jean-Claude Beisser, La Chaux de Fonds, Switzerland

[73] Assignee: Societe Nouvelle Transfix, Cahors, France

[21] Appl. No.: 718,014

[22] Filed: Mar. 28, 1985

Related U.S. Application Data

[62] Division of Ser. No. 527,650, Aug. 9, 1983, Pat. No. 4,588,971.

[30] Foreign Application Priority Data

Dec. 11, 1981 [FR] France ..... 81 23146

[51] Int. Cl.[4] ..... H01F 7/06

[52] U.S. Cl. ..... 29/605; 29/606; 29/609

[58] Field of Search ..... 29/605, 606, 609; 336/213, 198, 208

[56] References Cited

U.S. PATENT DOCUMENTS

| | | | |
|---|---|---|---|
| 2,160,588 | 5/1939 | Granfield | 336/213 |
| 2,220,733 | 11/1940 | Sanders | 336/213 |
| 2,248,606 | 7/1941 | Camilli | 336/198 |
| 2,359,173 | 9/1944 | Troy | 336/213 |

FOREIGN PATENT DOCUMENTS

| | | | |
|---|---|---|---|
| 2360402 | 6/1975 | Fed. Rep. of Germany | 336/208 |

*Primary Examiner*—Howard N. Goldberg
*Assistant Examiner*—P. W. Echols
*Attorney, Agent, or Firm*—Young & Thompson

[57] ABSTRACT

The transformer comprises a magnetic circuit (8) as well as, in the case of each phase, a high-voltage electric circuit (17) and a low-voltage electric circuit (18) both wound around at least one section of the magnetic circuit (8). The electric circuits (17, 18) are arranged in at least one electrically insulating annular coil form (11) which, under service conditions, is interposed between the electric circuits (17, 18) and the aforementioned section of the magnetic circuit (8). Utilization in particular is for improving the occupation of electric windows by the magnetic circuit and of magnetic windows by the electric circuit.

6 Claims, 20 Drawing Figures

FIG_6
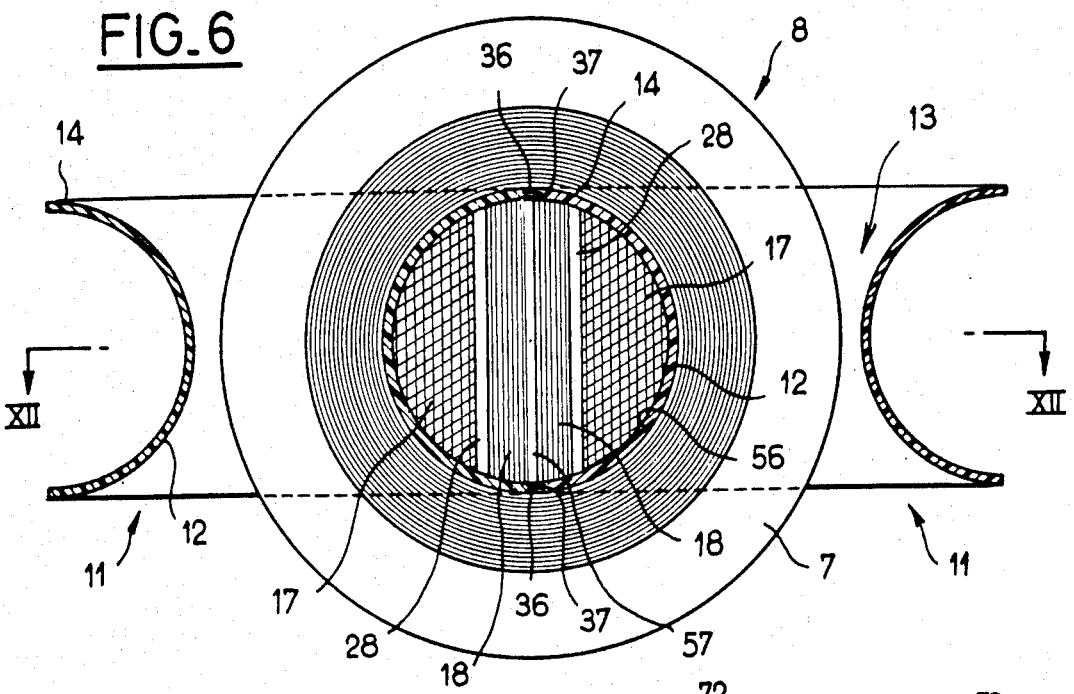
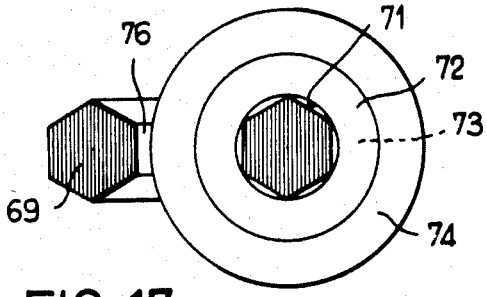
FIG_17
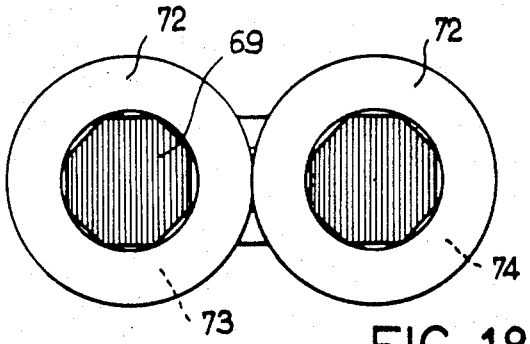
FIG_18
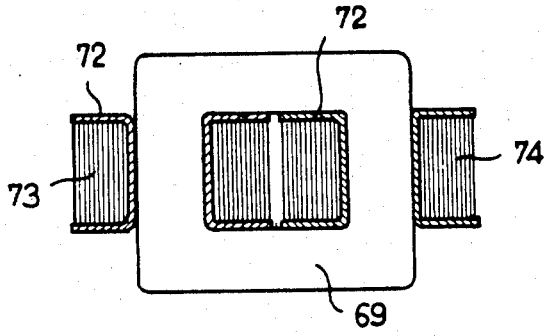
FIG_19
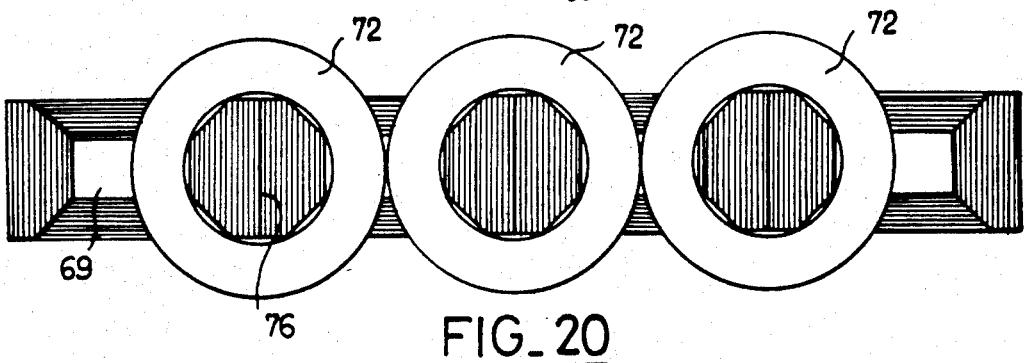
FIG_20

FIG_12
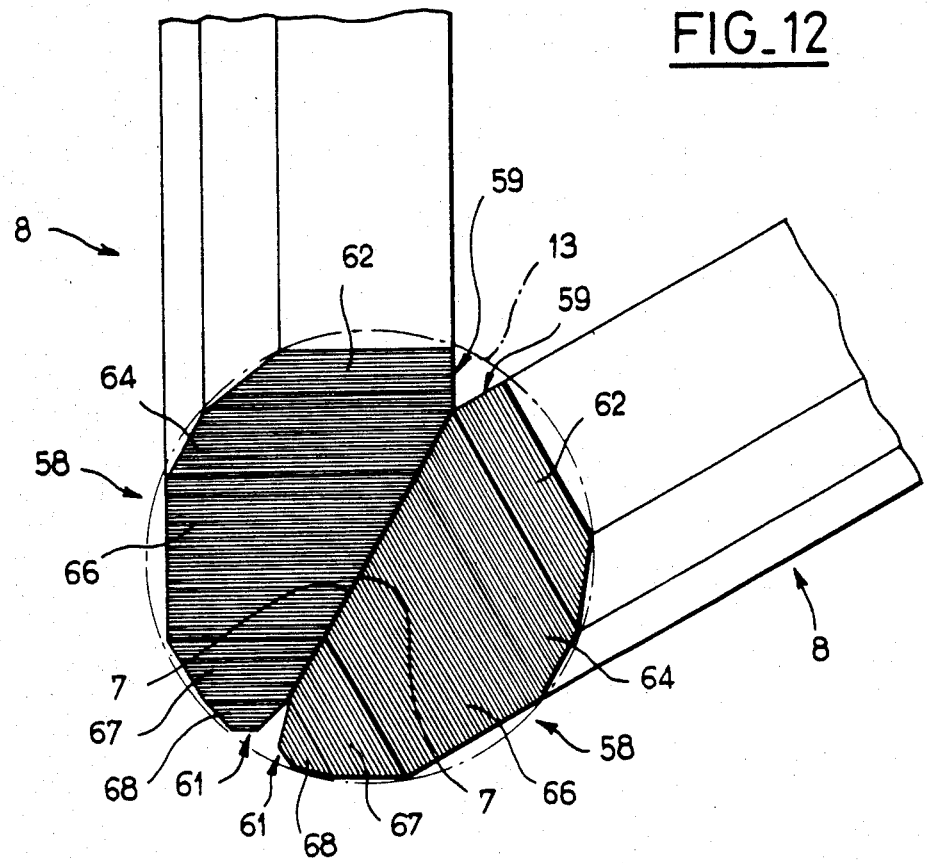
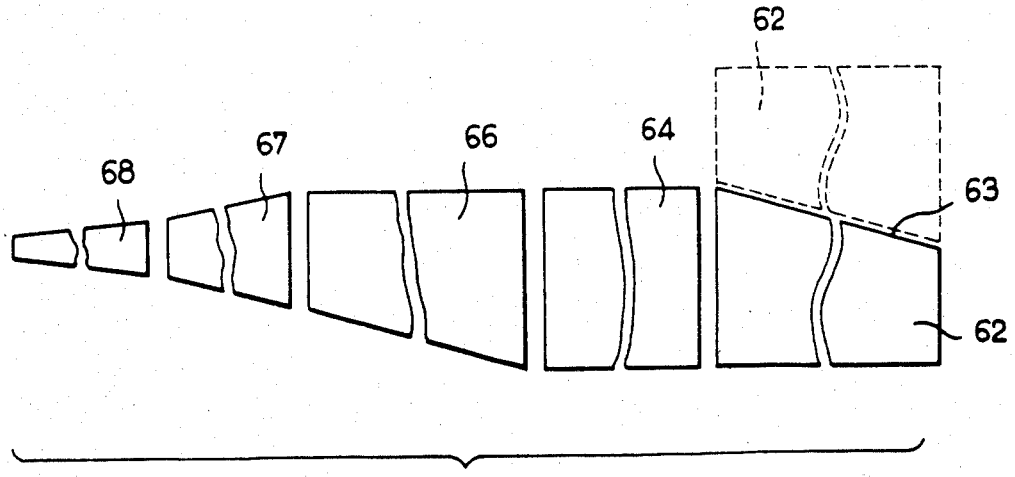
FIG_13

ELECTRIC TRANSFORMER AND METHOD FOR THE MANUFACTURE OF THE TRANSFORMER

This application is a division of application Ser. No. 527,650, filed Aug. 9, 1983, now U.S. Pat. No. 4,588,971.

The present invention relates to an electric transformer which is primarily but not exclusively applicable to the so-called "medium" power values, that is to say within the range of 5 to 1000 kVA approximately, and for single-phase or polyphase circuits.

The present invention is also concerned with a method for the construction of this transformer.

Known transformers comprise in a very general manner a magnetic circuit of sheet metal having certain zones surrounded by a high-voltage and/or low-voltage electric winding. The adjectives "high" and "low" are used here only in a relative sense to designate the circuits connected to the terminals of the apparatus between which the voltage under service conditions has respectively the highest and the lowest value.

There are different known methods of mounting an electric transformer; certain methods consist in mounting the electric circuits first, other methods consist in mounting the magnetic circuit first. In all cases, electrical insulation between the electric circuit and the magnetic circuit is achieved by means of insulating varnish with which the electric wires are coated and also by means of paper interposed at the time of assembly between the circuits of different types. In spite of this, it is also necessary to provide a gap between the electric and magnetic circuits; under service conditions, this gap is filled with electrically insulating oil contained in a tank which also houses the electric and magnetic circuits.

This conventional arrangement is attended by many disadvantages. During construction, the fitting of insulating paper is a delicate operation and difficult to perform automatically. Once the circuits have been completed, they have to be subjected to a long drying process under vacuum in order to extract the moisture from the large quantity of paper which is present and which is capable of performing its electrically insulating function only when it is dry.

Furthermore, the efficiency of a transformer is higher as the windows of the electric circuits are more completely occupied by the magnetic circuit. The gap which must necessarily be provided between magnetic circuit and electric circuits in the present state of the art plays an unfavorable part in this respect. It is also unfavorable from the point of view of weight and overall size of the apparatus. Furthermore, this gap entails the need to mount the electric and magnetic circuits independently of each other, which is made more difficult by the fact that the attachment means must afford resistance to the abrupt and violent forces which are liable to result from the appearance of a short-circuit in the power system to which the transformer is applied.

The aim of the invention is to overcome these disadvantages by proposing a transformer which is easy to construct and provides higher efficiency in spite of a smaller overall size.

In accordance with the invention, the electric transformer, comprising a magnetic circuit as well as, for each phase, a high-voltage electric circuit and a low-voltage electric circuit both wound on at least one section of the magnetic circuit, is characterized in that the electric circuits are arranged within at least one electrically insulating annular coil form which, under service conditions, is interposed between these electric circuits and the aforementioned section of the magnetic circuit.

Thus, the coil form ensures perfect insulation between the electric and magnetic circuits without entailing any need to provide either insulating paper or a gap between these circuits. The presence of the coil form considerably facilitates the winding of the electric circuits and also the construction of the magnetic circuit which can form with the coil form a practically rigid interengaged assembly whereas, in the present state of the technique, it had hitherto proved necessary to avoid any mutual contact between magnetic and electric circuits at the risk of damaging the insulation of the electric circuits. The coil form can be securely attached without any difficulty to any structural member such as a tank which surrounds the transformer. The efficiency of the transformer thus produced is excellent since the section of the magnetic circuit can fill practically the entire window of the electric circuit. Furthermore, the overall size of the apparatus is very small since the electric circuit can fill practically the entire window of the magnetic circuit.

In an advantageous version of the invention, which is adapted to the case of single-phase transformers in which the high and low-voltage windings are wound around two separate sections of the magnetic circuit, or to the case of polyphase transformers, the magnetic circuit has at least one window traversed by two coil forms surrounding two sections of magnetic circuit which are opposite relatively to this window, each coil form being such as to have a profile which coincides substantially with the half-profile of the window considered of the magnetic circuit.

Thus the two coil forms are combined so as to form together around the electric circuits an insulating sheath which separates them completely from the magnetic circuit.

In accordance with another object of the invention, the method for producing a transformer of the type described above is characterized in that the electric circuits are wound in the coil form and that, in order to construct the magnetic circuit, at least one thin strip of magnetic material which is suitably split is wound around a section of the coil form, this latter being employed as a guide for winding the thin strip.

In accordance with this method, the coil form, in addition to its numerous advantages set forth above, greatly facilitates the construction of the magnetic circuit which can be wound directly on the coil form without any risk of damaging the electrical insulation.

Other particular features and advantages of the invention will also result from the description given hereinafter.

In the accompanying drawings which are given by way of non-limitative examples.

FIG. 6 is a sectional view taken along the section line of FIG. 4, assuming that the two magnetic rings not located in this plane have been removed;

FIG. 12 is a partial view of the magnetic circuit taken in cross-section along the plane XII—XII of FIG. 6;

FIG. 13 is a schematic view showing the different thin strips employed in the construction of a magnetic ring;

FIG. 17 is a top view of a single-phase transformer with axial cross-section of the magnetic circuit;

FIG. 18 is a view which is similar to FIG. 17 but illustrating a transformer in which the high-voltage and low-voltage electric circuits are mounted in two separate coil forms;

FIG. 19 is a view of an alternative form of the transformer of FIG. 18; and

FIG. 20 is a view which is similar to FIG. 18 but illustrating a three-phase transformer in which all the rings of the magnetic circuit are located in the same plane.

Figure 1:
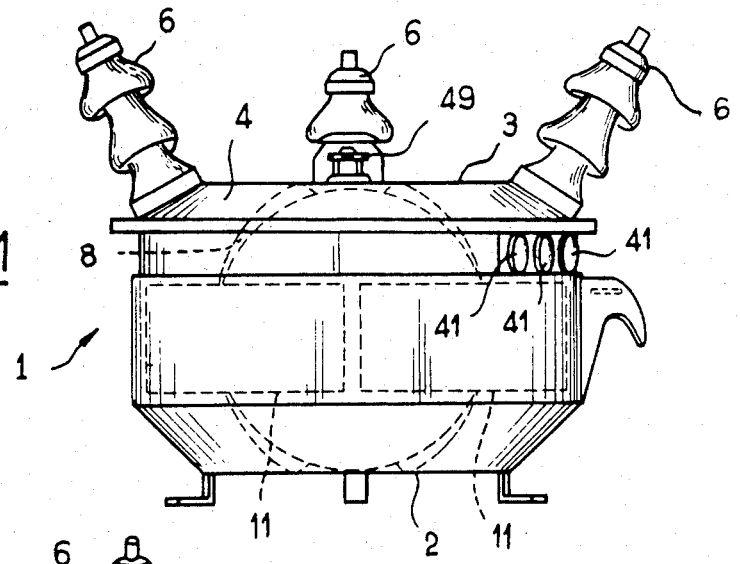
FIG. 1 is a view in side elevation of a three-phase transformer in accordance with the invention.

In the example illustrated in FIGS. 1 to 16, the three-phase transformer is arranged within a tank having a triangular cross-section with rounded vertices, having a bottom wall 2 and a cover 3, the periphery of which is constituted by an oblique wall 4 which carries the three high-voltage terminals 6 of the apparatus in angularly spaced relation. In service, the tank 1 is filled with electrically insulating mineral oil.

The transformer proper comprises a magnetic circuit constituted by three circular rings 8 formed of magnetic sheet metal, each ring being provided with a frusto-conical face 7 whereby it is applied against the frusto-conical face 7 of the other two rings in such a manner as to ensure that the planes of the rings 8 are disposed along the lateral faces of a prism. The structure of the magnetic rings 8 will be described in detail hereinafter.

The transformer also comprises electric circuits 9 which are disposed around the magnetic circuit, each around one of the sections in which two rings 8 are contiguous.

In accordance with the invention, the electric circuits 9 are arranged in coil forms 11 having a tubular central portion 12 of circular section around which are wound the electric circuits, and provided within the interior with a window 13 for the passage of the magnetic rings 8. Provision is made at each end of the central portion 12 for a flange 14 which is directed radially outwards for maintaining the electric windings laterally. The portion 12 and the two flanges 14 combine to give the coil form a semi-circular profile.

Figure 7:
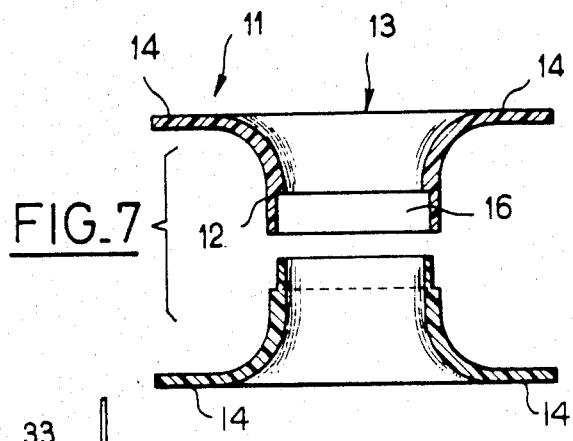
FIG. 7 is a schematic view of a coil form prior to assembly.

The coil forms 11 are made of insulating material such as plastic material. As shown in FIG. 7, the coil forms 11 are made of two parts engaged one within the other along an engagement surface 16 which surrounds the central portion 12 at an equal distance from the flanges 14. The joint surface 16 forms a step, the height of which can be adjusted in such a manner as to reserve, between the window 13 and the annular housing reserved for the electric circuits, a leakage path of sufficient length to prevent any electric flashover between the electric windings and the magnetic rings.

Figure 10:
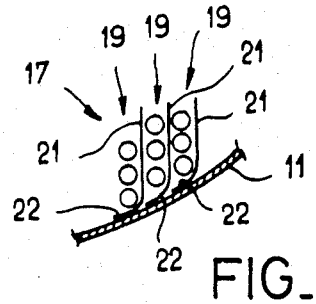
FIGS. 10 and 11 are views to a larger scale of the details X and XI of FIG. 8.
Figure 11:
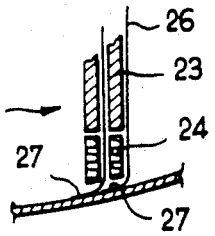
Figure 8:
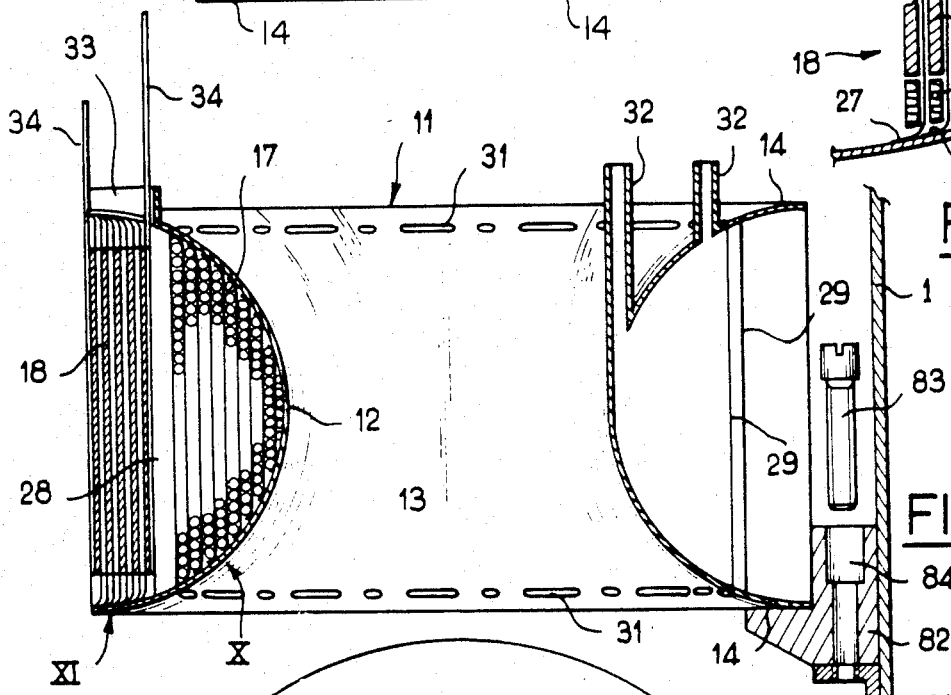
FIG. 8 is a sectional view taken along the plane VIII—VIII of FIG. 9 and showing a coil form with its electric circuits.

Each coil form 11 contains a high-voltage circuit 17 (FIG. 8) and a low-voltage circuit 18. In accordance with an important feature of the invention, the high-voltage circuit 17 is formed by turns of copper or aluminum wire located at the bottom of the coil form 11, that is to say against the central portion 12. As shown in FIGS. 8 and 10, the turns of the circuit 17 are arranged in rows 19 separated by sheets of insulating paper 21. At each layer, the sheets 21 have a width which is slightly greater than the width available within the interior of the coil form. This excess width serves to form on each side of the layer of turns located above the sheet 21 a paper flange 22 between this layer 19 and the wall of the coil form 11.

The low-voltage circuit 18 is constituted by a laminated band 23 of aluminum wound around the high-voltage circuit 17. A narrow strip of paperboard 24 is interposed between each layer of the laminated band 23 and each flange 14 of the coil form. The laminated band 23, the narrow strips 24 as well as a sheet of paper 26 for separating the layers are wound in a single operation, the sheet 26 being provided, in the same manner as the sheets 21, with a flange 27 on each side of the laminated band 23.

Between the high-voltage circuit 17 and the low-voltage circuit 18, there is formed an annular duct 28 through which oil having a function of coolant is permitted to pass. The duct 28 is delimited by two sheets of paperboard 29 held in spaced relation by means of wood strips (not illustrated) which are parallel to the axis of the coil form. Opposite each annular end of the duct 28, the flanges 14 of the coil form 11 are provided with a series of openings 31 for enabling the duct 28 to communicate with the exterior of the coil form 11.

Each coil form 11 carries in addition two chimneys 32 which are directed axially towards the cover 3 of the tank 1, each of which provides a lead-out passage for one end of the high-voltage winding 17. Moreover, each coil form 11 has a square recess 33 (FIGS. 8 and 9) directed towards the axis ZZ of the apparatus (FIG. 4), through which two tags 34 project towards the cover 3 and are welded to the ends of the low-voltage circuit 18.

Within the completely mounted apparatus, the three coil forms 11 are located in the same horizontal plane parallel to the bottom wall 2 of the tank and are attached to each other by means of their flanges 14. To this end, each flange 14 is provided with a tongue 36 displaced by 30° with respect to the recess 33 and with a housing 37 of corresponding shape located opposite to the tongue 36 with respect to the recess 33. The tongues 36 and the housings 37 of the different coil forms are engaged in interfitting relation and welded by the ultrasonic technique or bonded.

Figure 4:
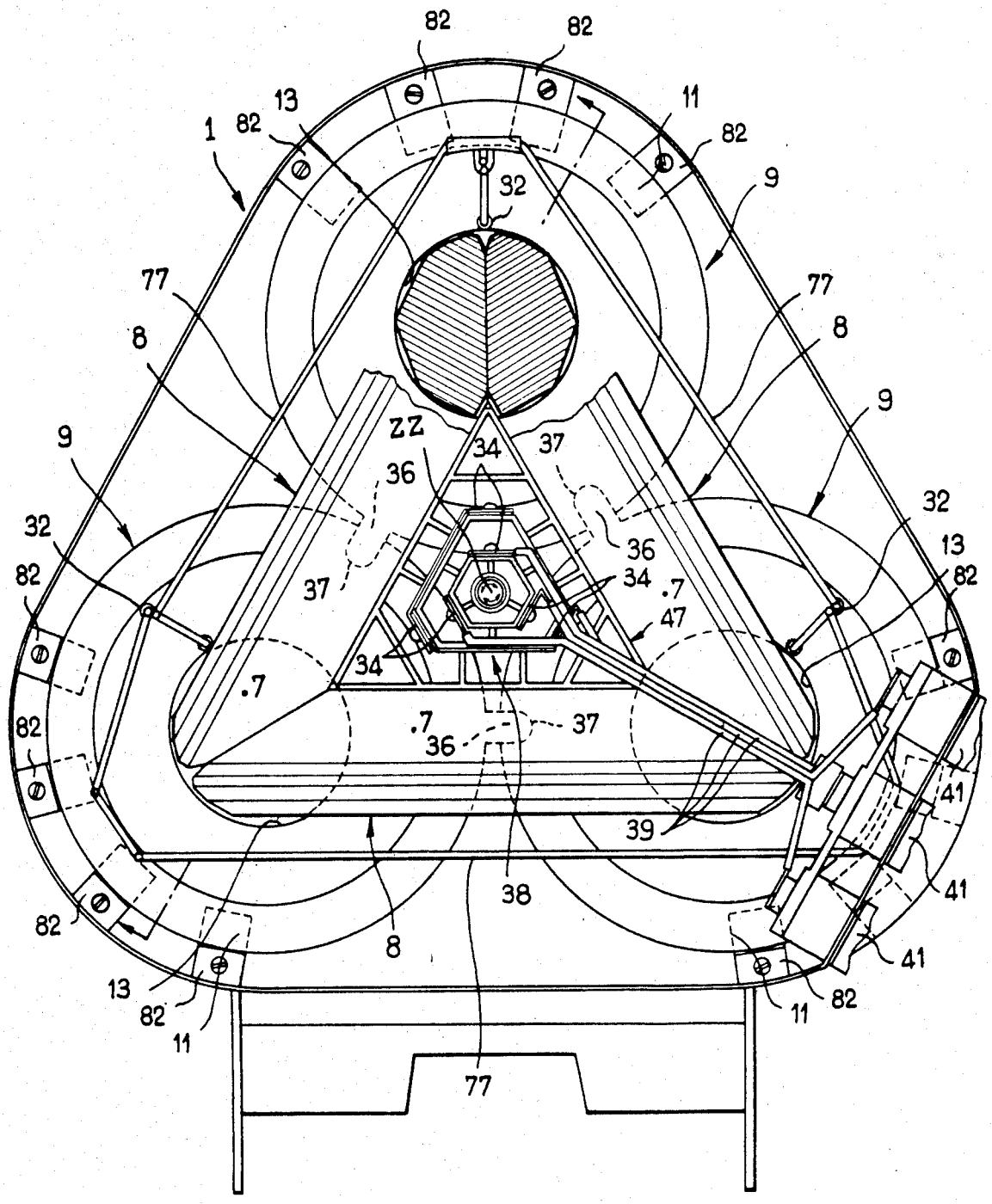
FIG. 4 is a more detailed top view of the transformer, the tank cover having been removed.
Figure 9:
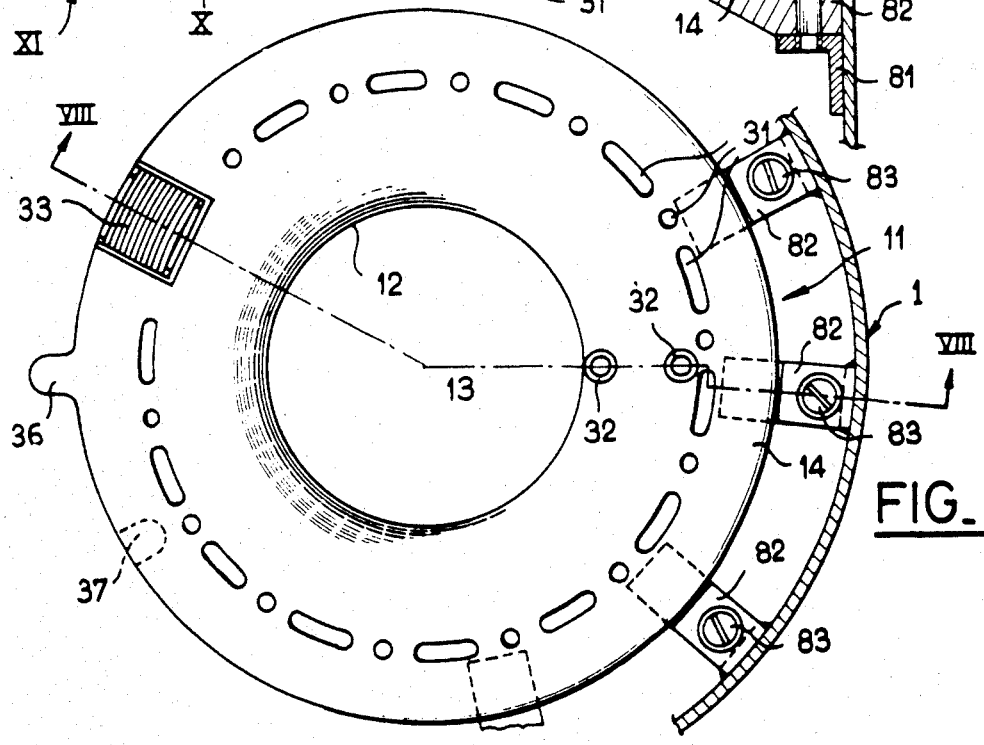
FIG. 9 is a top view of the coil form of FIG. 8.

As shown in FIGS. 4, 8 and 9, positioning of the active portion of the transformer within the tank can be carried out solely by means of coil forms 11 which rest on the lateral wall of the tank 1. Thus the coil forms 11 carry both the electric circuits 17, 18 and magnetic rings 8, which is particularly advantageous in the case of utilization of magnetic materials which lose their magnetic properties to an appreciable extent under the action of mechanical stresses. The coil forms 11 which are disposed concentrically with the rounded portions of the lateral wall of the tank 1 are each carried by four right-angled brackets 81 welded in angularly spaced relation in this rounded portion. Between the coil form 11 and each right-angled bracket 81 is interposed an insulating spacer member 82 which is attached to the right-angled bracket 81 by means of a screw 83 and the head of which, after assembly, is sunk within a well 84 of the spacer member 82 in order to avoid any risk of electric flashover. The spacer members 82 are shouldered in order to ensure at the same time the centering of the active portion of the transformer within the tank 1. A rubber sheet can be interposed between each bracket 81 and the spacer member 82 in order to absorb operational vibrations of the transformer.

Figure 14:
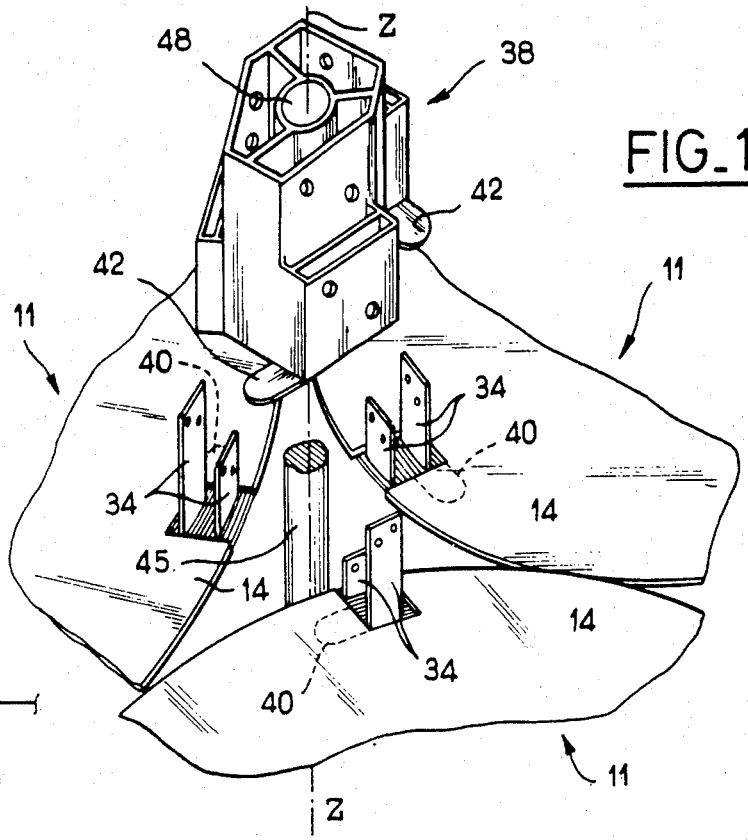
FIG. 14 is an exploded view in perspective with portions broken away showing the assembly of the low-voltage tapping unit on the top of the coil forms.

A single tapping unit 38 is connected to all of the six strips 34 which are joined to the six extremities of the three low-voltage windings 18 contained in one of the coil forms 11. From the tapping unit 38, which contains the internal connections within the transformer between the low-voltage windings, there extend three phase conductors 39 each connected to one low-voltage phase terminal 41 arranged on a flat surface of one of the rounded corners of the transformer tank. A fourth conductor (not illustrated) located beneath the conductors 39 connects the tapping unit 38 to a neutral terminal (not illustrated) arranged beneath the terminals 41. As shown in FIG. 14, the tapping unit 38 carries three tongues 42 which are intended to be welded by the ultrasonic technique or bonded at locations 43 of the coils 11. Once this attachment has been completed, the strips 34 are then riveted to the tapping unit 38.

Figure 2:
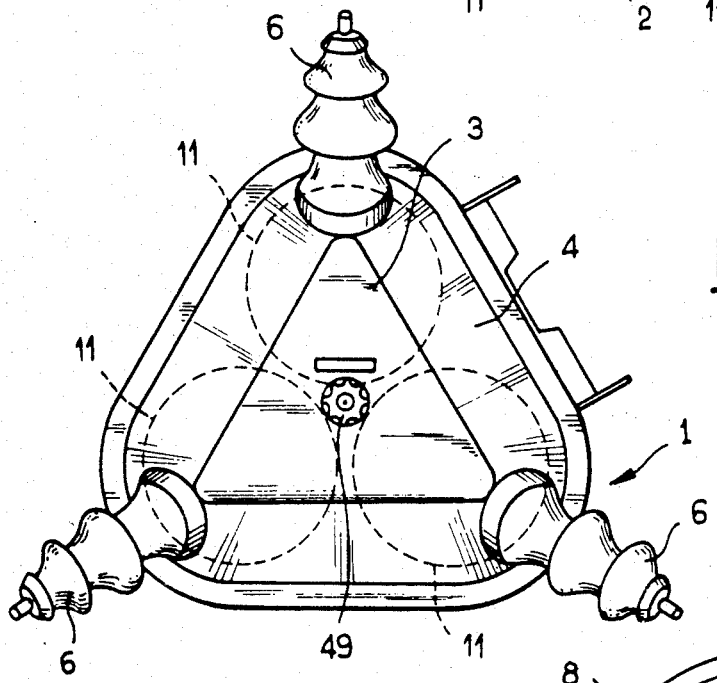
FIG. 2 is a top view of the transformer of FIG. 1.
Figure 3:
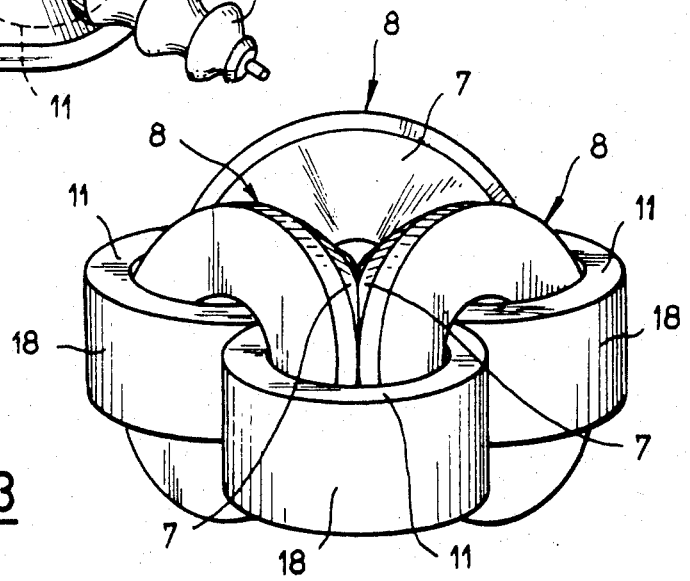
FIG. 3 is a schematic view in perspective showing the arrangement of the electric and magnetic circuits of the transformer of FIGS. 1 and 2.
Figure 5:
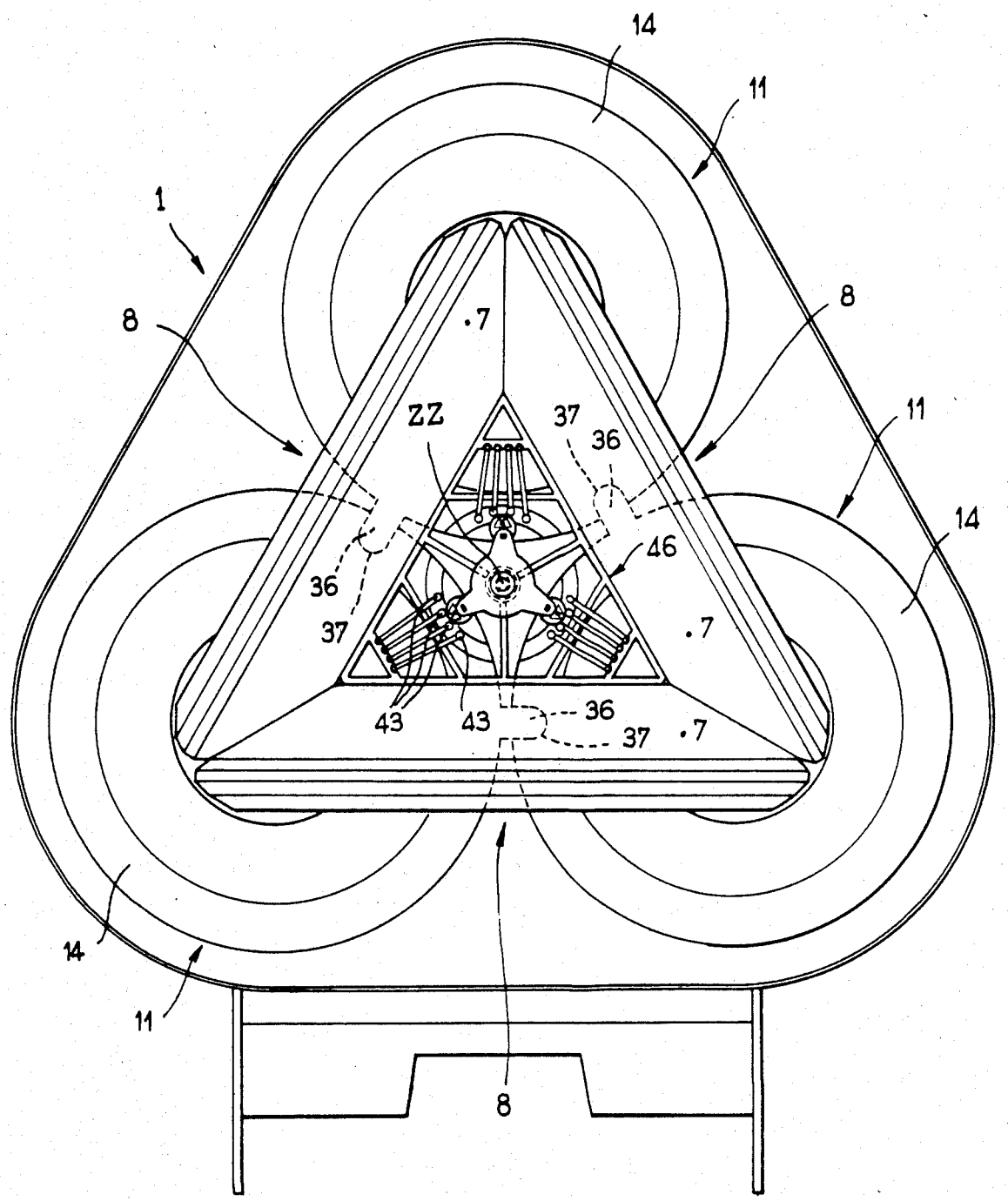
FIG. 5 is a bottom view of the transformer, assuming that the bottom of the tank has been removed.

The bottom face of the coil forms 11 is provided, approximately opposite to the strips 34, with a series of four contact studs 43 disposed in a circular arc centered on the axis ZZ (FIG. 5). The apparatus further comprises a three-point star switch 44 mounted for rotation about the axis ZZ by means of an operating rod 45 (FIG. 14) which passes through the apparatus along this axis and is supported by two bearings arranged within triangular frames of plastic material 46 (FIG. 5), 47 (FIG. 4) which are fitted between the magnetic rings 8, one frame 46 below and the other frame 47 above the coil forms 11. The tapping unit 38 has a bore 48 so as to provide a passageway for the rod 45 which also passes through the cover 3 of the apparatus and is connected at the exterior of this latter to a control knob 49 (FIGS. 1 and 2).

Figure 16:
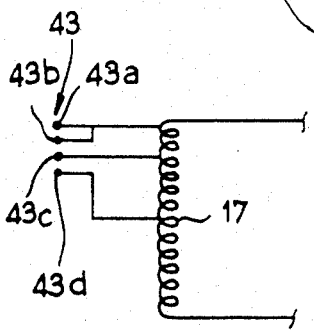
FIG. 16 is a schematic view of the wiring of the voltage-regulating contact studs.
Figure 15:
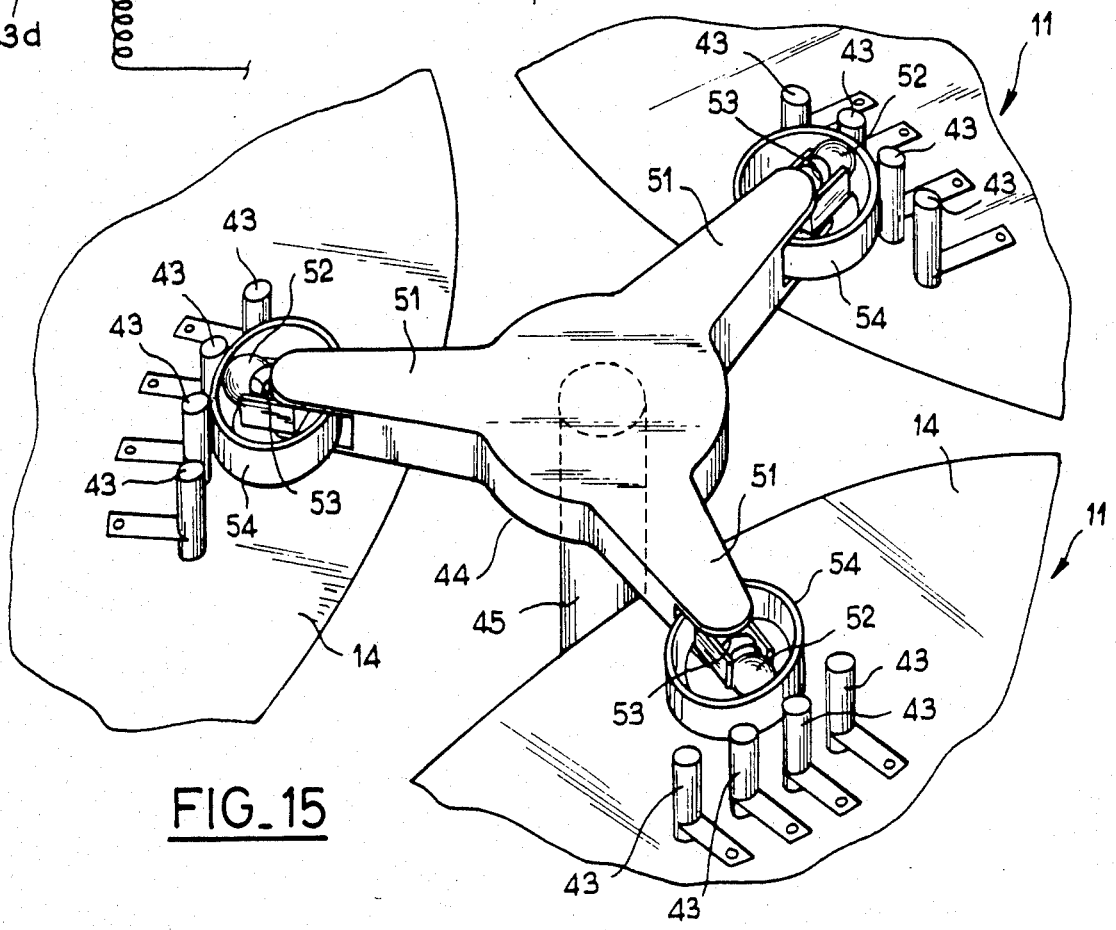
FIG. 15 is a view in perspective of the switch for adjusting the transformation ratio.

Each arm 51 of the switch 44 carries at its extremity a ball 52 thrust outwards by a spring 53 and applied against the internal wall of a tubular roller 54 which is capable of taking-up at will three rest positions in which it is placed astride two successive contact studs 43 between which it establishes a short-circuit. As shown in FIG. 16, the contact studs 43 are connected to the high-voltage winding 17 in such a manner as to ensure that two successive contact studs **43*a*, 43*b* are connected to the same turn, the contact stud 43*c* being separated from the contact studs 43*a*, 43*b* by a certain number of turns and the contact stud 43*d* being separated from the contact stud 43*c* by a double number of turns. Thus the switch 44 makes it possible by means of the control knob 49** to adjust the number of active turns of the high-voltage circuit and consequently the transformation ratio of the transformer.

As shown in FIG. 6, in the assembled transformer, the circular window 56 provided in each magnetic ring 8 is practically entirely occupied by two pairs of electric circuits 17, 18 in a location such that the coil forms 11 which contain them and are assembled together by means of the tongues 36, housings 37, have a generally circular profile. Since the electric circuits which are thus juxtaposed in the plane of each ring 8 are the low-voltage circuits 18, the gap 57 reserved between them can be very thin without any risk of a short-circuit.

As shown in FIGS. 4 and 12, apart from their frusto-conical face 7, the magnetic rings 8 also have a substantially semi-toric face 58 whose profile is inscribed in a semi-circle, the diameter of which corresponds substantially to the diameter of the window 13 of the coil forms 11. Each substantially semi-toric face 58 is joined by means of its two annular edges 59, 61 to the frusto-conical face 7 of the ring 8. Thus, in the window 13 of each coil form 11, the two juxtaposed rings 8 together have a circular profile which occupies practically the entire window 13.

In the embodiment which is illustrated, the rings 8 are formed by means of thin strips of magnetic sheet metal wound around the geometrical axis of the ring. In order to obtain the desired profile of the rings 8, five thin strips are wound around each other. The first strip has the shape of a right-angled trapezium, the bases of which are perpendicular to the longitudinal direction of the thin strip. This strip is wound first, starting from its short base, and its inclined edge 63 being directed towards the exterior of the apparatus. The following thin strip 64 is rectangular; it is wound with a slight displacement towards the exterior of the apparatus at each turn in such a manner as to ensure that the face 7 of the ring has the requisite conicity with a vertex angle of 60°. The following thin strip 66 again has the shape of a right-angled trapezium, its inclined edge being located towards the interior of the apparatus in this instance. The thin strips 67 and 68 which are wound subsequently are both trapezoidal.

The thin trapezoidal strips can be formed without any wastage from a strip of constant width equal to the sum of the long base and of the short base of the desired trapezoidal strips. By splitting this thin strip along an oblique longitudinal line, there are obtained two strips in the shape of a right-angled trapezium, both of which have the requisite dimensions and can be employed within the scope of construction of two of the magnetic rings. This principle of splitting is represented schematically by the strip 62' shown in dashed lines in FIG. 13. The thin strips 67 and 68 which constitute non-right-angled trapeziums can be formed in the same manner from right-angled trapeziums which are inclined to a slight extent.

The method for constructing the above transformer will now be described:

the thin strips of magnetic sheet metal which are necessary for the construction of the magnetic circuit are prepared by splitting;

the thin strips of magnetic sheet metal are wound on a circular mandrel having substantially the diameter of the profile of the coil forms 11, in the position which they must subsequently occupy in the assembled transformer;

magnetic rings thus pre-assembled are caused to expand by subjecting them to a thermal annealing treatment;

the magnetic rings are unwound from the aforesaid mandrel and progressively re-wound to a larger winding diameter;

before, during or after the operations which have just been described, the high-voltage and then the low-voltage electric windings are wound on the coil forms 11;

the coil forms are assembled together, the different connections are established between the windings, in particular by positioning the tapping unit 38 and the interconnections 77 (FIG. 4) between the windings 17;

the set of three coil forms thus assembled are subjected to heating in an oven or to a vacuum drying operation which is intended to result in complete drying of the paper for insulating the electric circuits;

the magnetic rings 8 are then wound around the coil forms 11. The thin strips which are intended to constitute the rings 8 assume the requisite shape of their own accord since they have been annealed in this position;

the coil forms 11 are fixed within the tank 1, the terminals 6 and 41 are connected to the tapping unit 38 and the system of interconnections 77, the tank is filled with oil and the cover 3 is closed.

The foregoing description of the example of FIGS. 1 to 16 has served to point out the many advantages of the invention, namely: gain in weight and overall size, gain in performance and efficiency of the transformer, ease of manufacture and removal of the many previous risks of damage to the electric circuits during this manufacture, secure and easy attachment of the active portion within the tank by virtue of the coil forms which can be securely attached to the tank without any risk of short-circuit or any risk of damage to the circuits. Up to the present time, many methods consisting of winding the magnetic circuits after having wound the electric circuits had been proposed. However, these methods, which were intended to permit the possibility of providing magnetic circuits without any discontinuity, had never met with any practical application since no effective means had been found for carrying out this winding operation without damaging the electric circuits. The invention has overcome this impossibility. Furthermore, winding of the magnetic circuits which can be performed without taking great precautions in regard to the electric circuits is very rapid. This permits a saving of time and also makes it possible to heat the electric circuits in an oven prior to installation of the magnetic circuits. Heating in an oven, which is already considerably shortened by reason of the distinctly smaller quantity of insulating paper to be provided, is shortened even further without the magnetic circuits. The very fast winding of the magnetic circuits does not give the insulating paper the time to re-absorb moisture before the assembly is immersed in the oil of the tank.

All these advantages obtained within the scope of the preferred embodiment of FIGS. 1 to 16 can also be obtained within the scope of other embodiments such as those illustrated in FIGS. 17 to 20.

In FIG. 17, the single-phase transformer comprises a circular magnetic circuit 69 whose circular profile is exactly inscribed in the circular window 71 of a coil form 72 of semi-circular profile which contains a high-voltage electric circuit 73 in the bottom portion thereof and a low-voltage electric circuit 74 on its periphery. The circuit 74 projects to a substantial extent beyond the coil form, with the result that the assembly consisting of coil form 72, circuits 73 and 74, has a substantially circular cross-section which corresponds approximately to the window 76 of the magnetic circuit 69. However, it is readily apparent that any contact between the circuit 74 and the ring 69 must be avoided. A relatively small gap is sufficient for this purpose since the circuit 74 is the low-voltage circuit.

In the example of FIG. 18, the circuit 69 is surrounded, in two diametrically opposite sections, by two coil forms 72 which are located substantially in the same plane. One of the coil forms contains the high-voltage electric circuit, the other contains the low-voltage electric circuit. The magnetic ring 69 can be circular in the same manner as the rings 8 of FIGS. 1 to 16.

However, as shown in FIG. 19, the ring 69 can also be rectangular or square, in which case the coil forms 72 are cylindrical with flat flanges. Though advantageous from the point of view of overall size, this solution nevertheless has a disadvantage in that the magnetic circuit cannot be formed in accordance with the method which has been described with reference to FIGS. 1 to 5. It must either be formed by means of stacked sheet metal strips joined together in a miter-joint assembly, for example, as shown in FIG. 19 or else by means of sheet metal strips wound directly around the coil forms without any possibility of annealing since this latter would obviously damage the electric circuits.

The example of FIG. 20 is similar to that of FIG. 18 but applied to a three-phase transformer. The magnetic rings 69 have a semi-circular profile which is limited externally by a cylindrical surface 76. They are four in number, all four being disposed in the same plane with their axes in the same plane. The coil forms 72, which are three in number, each contain a high-voltage circuit and a low-voltage circuit and each have a semi-circular cross-section. They each surround one of the sections of the magnetic circuit in which two rings 69 are tangent. The coil forms 72 are also located in the same plane with their geometrical axes in the same plane.

It is therefore apparent from these examples which have been briefly described that the coil forms in accordance with the invention are applicable to a very large number of transformer structures and provide substantial advantages in each case.

As can readily be understood, the invention is not limited to the examples which have been illustrated and many alternative arrangements can be made in these examples without departing from the scope of the invention.

Thus it follows that the invention is not limited to single-phase or three-phase transformers and that apparatuses having a greater number of phases can naturally be constructed with the same advantages.

The invention advantageously lends itself to the use of amorphous magnetic materials—also known as metallic glasses—for the fabrication of the magnetic rings. In fact, metallic glasses provided in the form of strip of approximately 1/100 mm offer their excellent magnetic properties only when they are quite free of mechanical stresses. This condition, although usually difficult to meet, is automatically satisfied by means of the invention when the coil forms are alone attached to the tank and carry the magnetic circuits. The thin strip of metallic glass can be wound so as to form a structure which closely resembles those illustrated in the figures, the number of turns of winding being naturally greater.

Moreover, the thin strip which serves to form the low-voltage electric circuits can be of copper. The cooling ducts 28 can be fabricated from a profiled member of flexible plastic material having substantially the shape of a ladder which is deformed in order to surround the high-voltage electric circuit before winding the thin strip of the low-voltage electric circuit. The three contact studs 43*a* forming part of the three coil forms 11 can be connected together electrically, thus making it possible in a very simple manner to mount the high-voltage circuit in a star connection.

I claim:

1. A method of manufacturing a transformer comprising the steps of forming electric windings (17 and 18) around at least two electrically insulating annular coil forms (11); attaching the coil forms to each other by adjacent edges of said forms; forming a suitably shaped thin strip of magnetic material (62, 64, 66 to 68) by a splitting process; and then winding around a section of the coil forms at a location in which the coil forms are attached to each other said thin strip of magnetic material while using the coil forms as a guide for winding such that said thin strip is wound through a center of said annular coil forms.

2. A method according to claim 1, wherein the magnetic material is sheet metal, and wherein, before being wound on the coil form (11), the thin strip is wound on a circular mandrel and then the stresses in the thin strip are released by a thermal treatment of the thin strip, whereupon the thin strip is unwound from the mandrel.

3. Method according to claim 1 wherein said annular coil forms are of cylindrical shape and comprise flanges (14) which are directed radially outward from a top and bottom of said cylindrical shape and wherein the coil forms are attached to each other at said flanges, such that said electric windings are provided in a space enclosed by said attached flanges.

4. Method according to claim 3 in which said flanges contain a plurality of tongues (36) and housings (37) such that the flanges are attached by interfitting respective tongues and housings together.

5. A method as in claim 3 wherein said electric windings are wound around at lesat three annular coil forms, and wherein each coil form is arranged to be adjacent to at least two other coil forms such that all said coil forms are contained in a common plane, and winding at least three said magnetic strips through said at least three coil forms such that each winding is wound through at least two of said coil forms and such that each center of said coil forms has two strips wound through it.

6. Method according to claim 5 in which said windings are formed from a plurality of thin trapezoidal strips into a desired shape, such that when said two magnetic strip windings are wound through said coil form the cross-sectional area of said coil form is nearly completely occupied.

* * * * *